US006044740A

United States Patent [19]

Werkheiser

[11] Patent Number: 6,044,740

[45] Date of Patent: Apr. 4, 2000

[54] PUSH STICK

[76] Inventor: Lester E. Werkheiser, 5724 Oakland Rd., Eldersburg, Md. 21784-6829

[21] Appl. No.: 09/161,880

[22] Filed: Sep. 28, 1998

[51] Int. Cl.[7] ..... B27B 25/10

[52] U.S. Cl. ..... 83/436.2; 83/437.2; 144/245.1

[58] Field of Search ..... 83/437.2, 435.15, 83/435.16, 435.11, 436.2; 144/245.1

[56] References Cited

U.S. PATENT DOCUMENTS 4,485,711 12/1984 Schnell .
5,016,509 5/1991 Stottman .
5,692,425 12/1997 Sterling .

*Primary Examiner*—Rinaldi I. Rada
*Assistant Examiner*—Dominic J Troiano

[57] ABSTRACT

A push stick for use with stationary power tools including table saws and shapers. The push stick has a flat base plate that can ride on the surface of the power tool thereby providing stable operation with a resulting increase in safety for the operator and more accurate cutting. A handle of the push stick is placed at an optimum angle to provide both downward and forward pressure on a work piece. The push stick may also be equipped with a variable handle angle to optimize its use with different power tools. The base plate of the push stick may be adjustable in thickness to accommodate work pieces of different thicknesses.

20 Claims, 7 Drawing Sheets

100

PUSH STICK

BACKGROUND OF THE INVENTION

1. Field of the Invention

This invention is related to a safety device for use with stationary power tools. In particular, the invention is related to an apparatus that permits an operator to safely guide wood or similar soft materials past a rotating or an oscillating cutting element.

2. Description of Related Art

Operators of circular saws, shapers, band saws and similar stationary power tools must exercise caution when pushing a work piece towards a rotating or oscillating saw blade, a rotating shaper cutter, or a rotating sanding disk. All of these devices can be categorized as cutting element in that they remove an unwanted portion of the work piece. These cutting elements also have the undesirable potential to cause severe injury to the user if they contact a portion of the user's body, normally the hands, or if they cause the work piece to be ejected from the stationary power tool such that the work piece, or a portion thereof can strike the user. The work pieces can be ejected because some cutting elements apply a rotational or a translational force to the work piece.

Push sticks have been devised that contact the work piece and include a handle that allows the operator to guide the work piece past the cutting element while removing the user's hands from the cutting path of the cutting element. These push sticks also allow the user to apply a force to the work piece that tend to counteract the rotational and translational forces applied by the cutting element.

Push sticks are not always employed when operating stationary power tools for a variety of reasons. Push sticks are usually small devices that can easily be misplaced. They cannot be conveniently stored near the stationary power tools. Push sticks do not incorporate ergonomic designs that make them easy to use and effective in holding down and guiding a work piece. FIG. 1 shows a conventional push stick 10. The push stick 10 has a generally rectangular shape with a handle portion 12 and a hold down portion 14. The hold down portion 14 includes a notched region 15 that is used to engage the work piece. The notched region 15 provides for some downward and forward forces to be applied by the operator to the work piece. However, the notched region 15 cannot provide a sufficient downward force to hold down long or twisted work piece, or work pieces with knots. Furthermore, the push stick 10 can easily slip during cutting operations, or get in the way of other safety devices such as a saw blade guard. Finally, the push stick 10, while easy to store, may be easily lost among the clutter of a machinery shop. These shortcomings may tempt the operator to use his free hand to help guide the work piece through the cutting element, to dispense with the push stick 10 entirely, or to remove other safety features such as the saw blade guard.

SUMMARY OF THE INVENTION

This invention provides a safety device that may be used with stationary power tools, such as table saws and jointers. The safety device is a push stick that is used to guide work pieces past the cutting elements of the stationary power tools. The push stick is provided with a flat bottom surface that rides on a table surface of the stationary power tool, an elongate handle that is used to provide forward and downward force on the work pieces, and a hold down section to secure the work piece. The push stick is constructed with its center of gravity located such that the push stick will sit on its flat bottom surface. This design provides significant improvement over conventional push sticks because it ensures that stability of the push stick depends on its contact with the table of the stationary power tool, rather than on its contact with the work piece.

The push stick preferably has the elongate handle inclined 45 degrees to a longitudinal axis of the push stick. This inclined orientation ensures that an operator can maintain both a forward motion of the work piece and downward pressure on the work piece. However, the push stick may have the handle inclined at any orientation from zero degrees to 90 degrees.

In another embodiment, the push stick has an adjustable elongate handle. The adjustable handle makes the push stick more versatile in that the handle may be rotated to suit the type of stationary power tool in use.

In another embodiment, the push stick includes a main section and an auxiliary section. The main section is designed as in previous embodiments. The auxiliary section connects to the main section by a bridge. In operation, the push stick may be used to guide narrow work pieces between the cutting element and a guide fence of a table saw, for example. The main section rides on the table of the stationary power tool to provide the needed stability. The auxiliary section contacts and guides the narrow work piece. The bridge connection the main and the auxiliary sections is high enough to clear a saw blade of the table saw when the push stick is pushed past the saw blade.

In yet another embodiment, the bottom surface of the push stick may be adapted to receive shims of varying thickness. By using the shims, the push stick can be adjusted for use with work pieces of any thickness, while still maintaining the bottom surface in contact with the table surface of the stationary power tool. The shims may connect to the push stick by means of a sliding dove tail arrangement, for example.

BRIEF DESCRIPTION OF THE SEVERAL VIEWS OF THE DRAWINGS

The invention will be described with reference to the following drawings, wherein like numbers refer to like elements and wherein.

DETAILED DESCRIPTION OF THE INVENTION

Cutting and shaping operations involving stationary machines raise two concerns. Most important is the risk of injury to an operator. Next is ensuring accuracy of the cutting or shaping operation. For example, woodworking operations involving stationary machine often put an operator's hands within close proximity of a cutting element such as a rotating or translating saw blade, a shaper cutter and the like. This close proximity can lead to severe injury if the operator's hand was to contact the cutting element. Contact with the cutting element is possible because of simple careless operation. However, an operator can lose control of a work piece because of the many forces that act on the work piece as it progresses through the cutting element. One of the most dangerous stationary power tools to use is the table saw. A table saw has a flat table through which projects a circular saw blade that is typically 10 to 12 inches in diameter and rotates at a speed of 3,000 rpm in a direction opposite to the direction of feeding the work piece. That is, the saw blade rotates toward the operator. During ripping operations, a guide fence is normally used to ensure a straight cut. The guide fence is aligned parallel to the saw blade. A part of the work piece that is being ripped (the cutoff piece) passes between the guide fence and the saw blade. The other part of the work piece that is being ripped passes along the side of the saw blade that is away from the guide fence. During cutting operations, particularly during ripping, a table saw will exert a force that tends to lift the cutoff piece off the table surface and a force that tends to propel the work piece back toward the operator. This upward and backward thrust results from the force of the saw blade as it contacts the work piece and the friction between the rear edge of circular saw blade and the cutoff piece. Once the cutoff piece has been pushed past the center of the saw blade, there is little force applied to the cutoff piece.

Other stationary power tools create hazards because of the high speed of the cutting element, and the various forces that the cutting element applies to the work piece. For example, shaper cutters typically rotate at 10,000 rpm and may be 4 to 6 inches in diameter. Like table saws, shapers usually produce a force that acts opposite to the direction of feed.

In addition to the normal forces created by these stationary power tools, when a work piece is near the end of its cut, the work piece can "dip" or move in an unexpected direction as the frictional force between the cutting element and the work piece rapidly decreases. This rapid reduction in force may cause the operator to loose control of the work piece, with the result that the work piece can be ejected from the stationary power tool, the operator's hands may be drawn toward the cutting element, and the accuracy of the cutting operation may be degraded.

Figure 1:
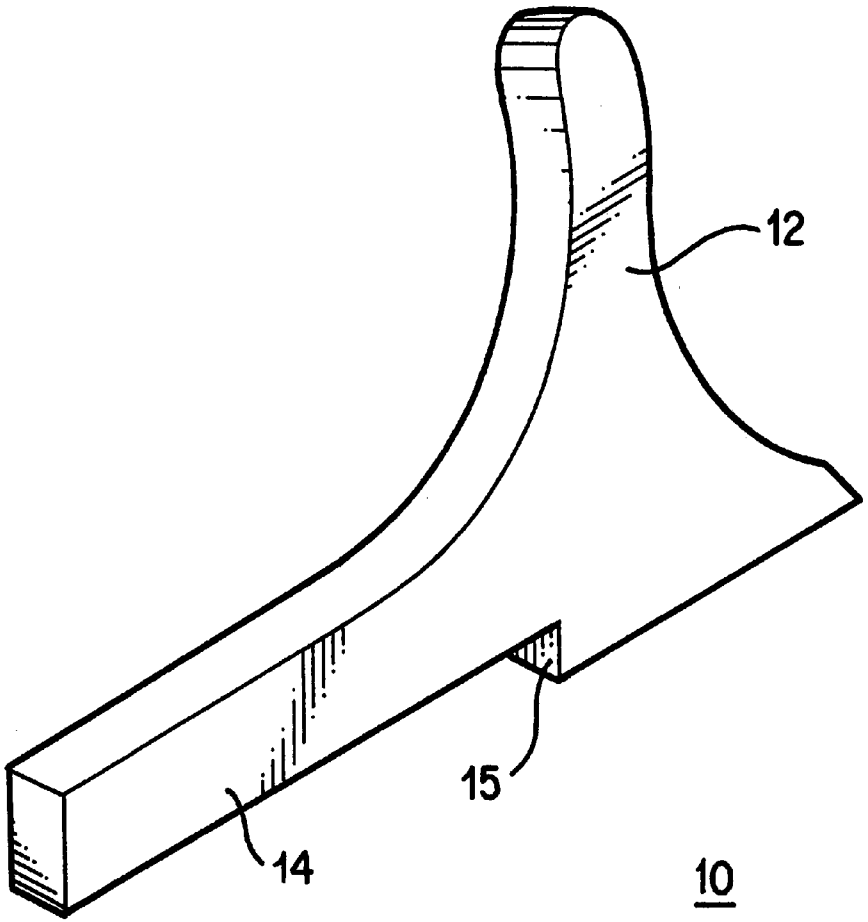
FIG. 1 (PRIOR ART)
FIG. 1 is a side view of a conventional push stick.

Protective devices such as the traditional push stick shown in FIG. 1 have been devised to guide the work piece past the cutting element while minimizing the proximity of the operator's hands to the cutting element. These conventional push sticks are also intended to ensure accurate cutting operations by allowing the operator to maintain an even pressure on the work piece as it passes through the cutting element. However, conventional push sticks suffer from several design deficiencies. Conventional push sticks used with table saws, such as the push stick shown in FIG. 1 provide little control over the upward thrust of the work piece that results from pushing the work piece past the circular saw blade. Furthermore, even if the length of the push stick is lengthened, the critical factor in maintaining safety is not only the proximity of the hand to the cutting element, but also the stability that the push stick provides when feeding the work piece through the cutting element. Because conventional push sticks do little to improve stability, they cannot provide the optimum degree of safety needed to operate stationary power tools.

Figure 2:
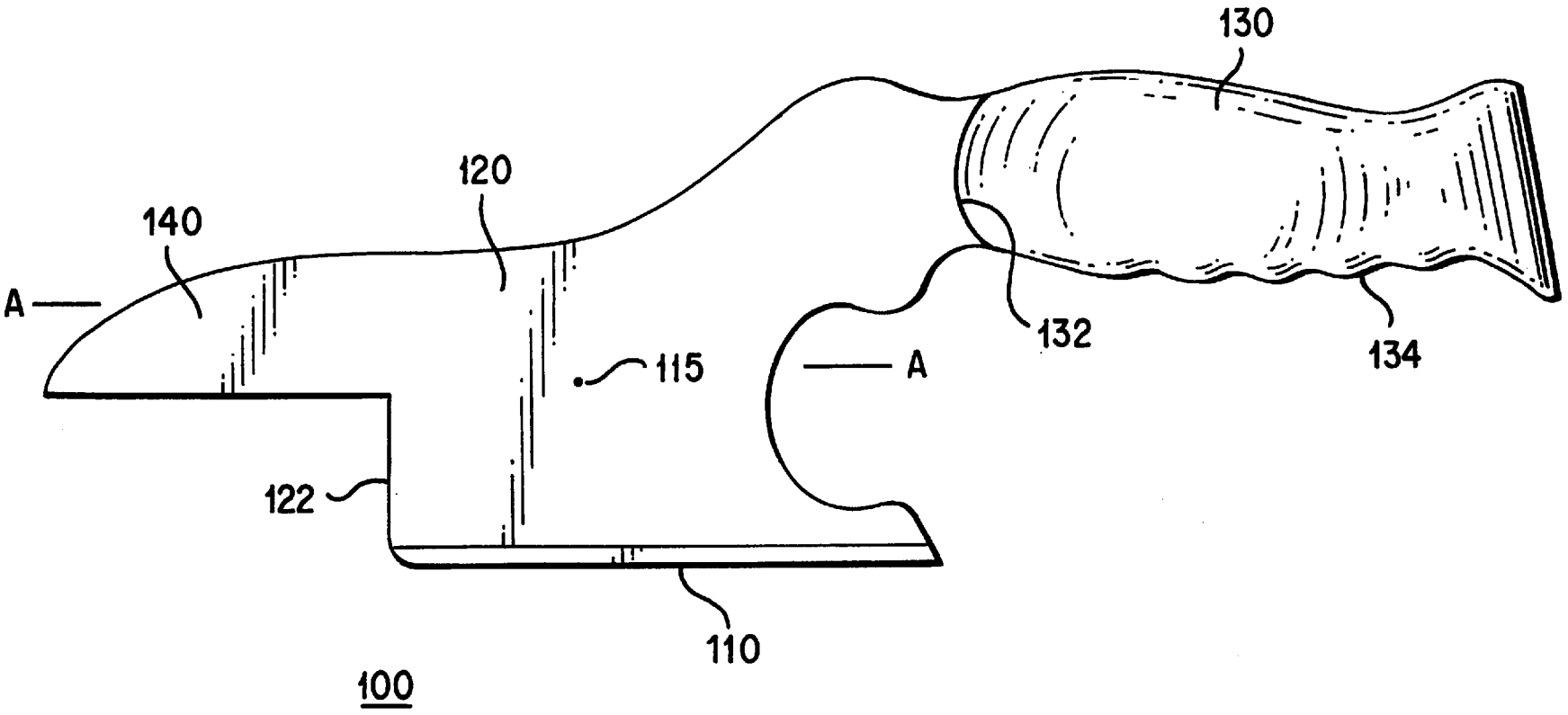
FIG. 2 is a side view of a push stick according to an embodiment of the invention.

FIG. 2 shows a push stick 100 according to an embodiment of the invention. The push stick 100 is made from a single piece of material such as high density hard woods (maple being ideal) or any suitable polymeric material. The push stick 100 includes a flat base plate 110, a center section 120 having a working end portion 122, an elongate handle 130, and a holddown section 140. The center of gravity of the push stick 100 is such that the push stick 100 will stand on its base plate 110 in a stable configuration, making for easy storage and accessibility of the push stick 100. Also as shown in FIG. 2, the holddown section 140 is of sufficient length to provide a downward thrust on the work S piece during most cutting operations. The center section 120 is also of sufficient length to allow the push stick 100 to push the work piece completely beyond the center of the cutting element without the operator's hands reaching the leading edge of the cutting element. For the standard table saw, this means that the center section is at least 6 inches in length. In this way, the end of the work piece will be beyond the center of the rotating element without the operator's hand reaching over the top of the rotating cutting element. With the end of the work piece beyond the center of the cutting element, there is little force available to lift the work piece or to project in rearward. The handle 130 is designed to apply the maximum downward force and forward thrust through the cutting element. The handle includes a thumb stop 132 and ridges 134 to provide a better grip. Optimally, the handle is formed at about a 45-degree angle with a line AA passing through the length of the push stick 100. Thus, the force applied by the operator is evenly divided to counteract both the upward and rearward forces created by the cutting element. For many cutting operations involving a table saw, the push stick 100 will provide for safe and reliable cutting operations.

Figure 3:
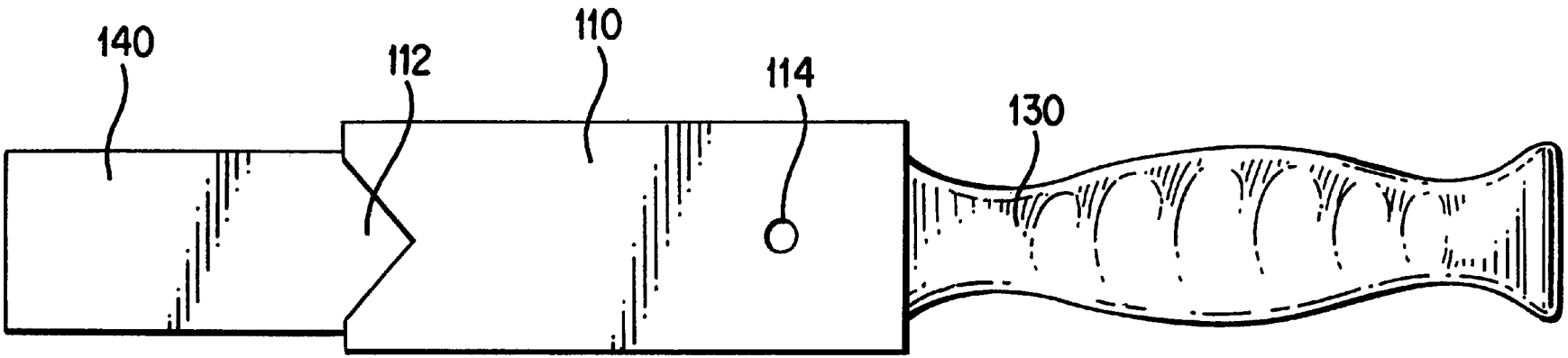
FIG. 3 is a bottom view of the push stick of FIG. 2.

FIG. 3 is a bottom view of the push stick 100. In FIG. 3, the flat base plate 110 is shown with a notched section 112 at its forward end. The notched section 112 allows the push stick 100 to be used with irregularly-shaped work pieces without sacrificing stability. The notched section 112 also allows the push stick 100 to be used to engage a corner or edge of a work piece.

Figure 4:
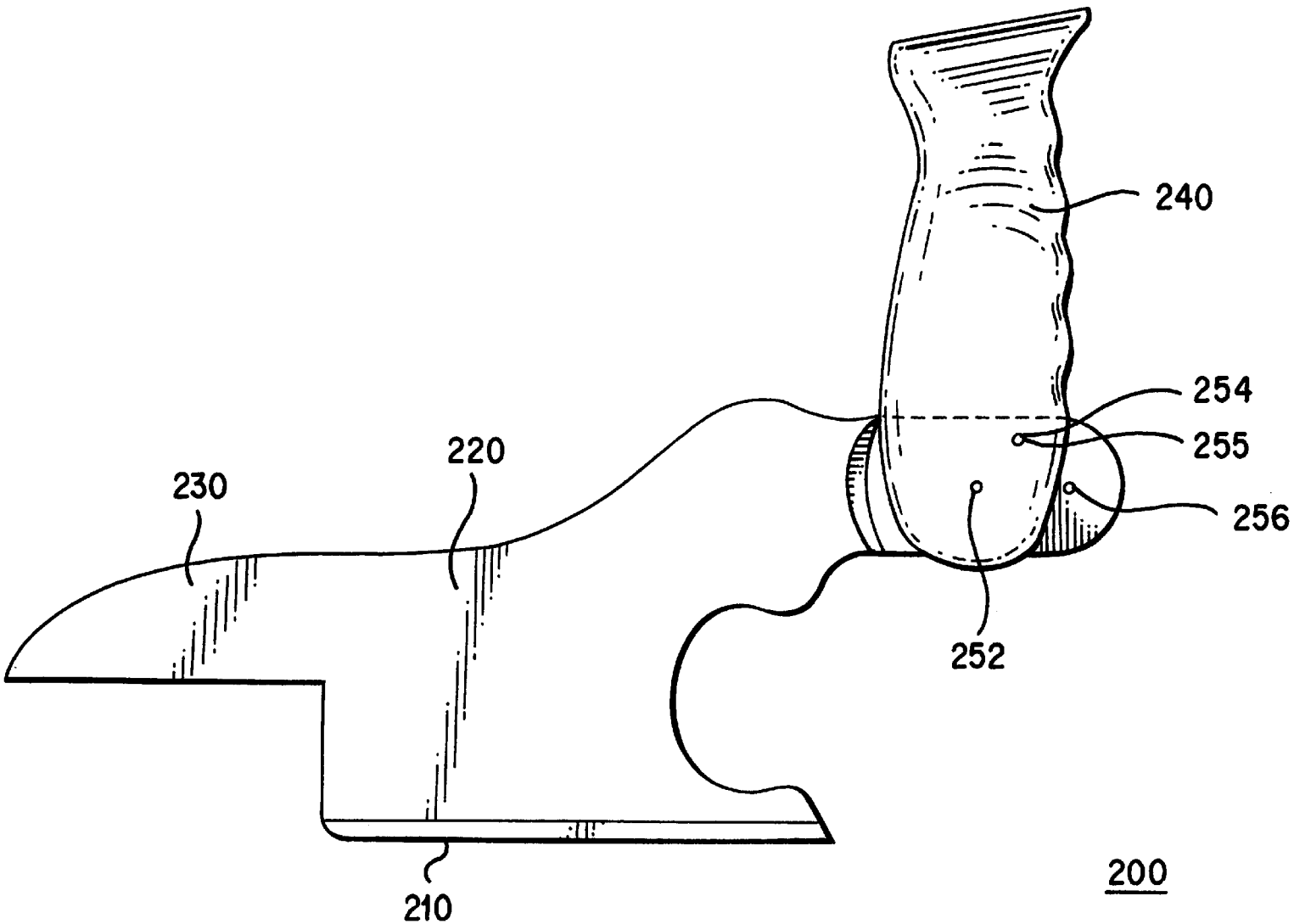
FIG. 4 is a side view of a push stick according to another embodiment of the invention.

FIG. 4 is a side view of a push stick 200 according to another embodiment of the invention. In FIG. 4, the push stick 200 includes a flat bottom plate 210, a center portion 220, an hold down 230 and an adjustable elongate handle 240. The handle 240 is adjustable by rotating about pivot point 252. The handle 240 can assume any angle from zero degrees to 90 degrees by pivoting about the pivot point 252 and is shown in FIG. 4 at a ninety-degree angle. Preferably the handle is positioned at a 45-degree angle when ripping on a table saw. The push stick 200 includes a positive stop 254 at 45 degrees and a positive stop 256 at 30 degrees. The positive stops 254 and 256 may be holes drilled in the center portion 220 and into which a restraining mechanism fits. At ninety degrees, the handle 240 is stopped by the upper position stop 256. The positive stops include a spring loaded pin 255 that acts as the restraining mechanism. The pin 255 is attached to the handle 240 and penetrates the handle 240 to engage the positive stops 254 and 256. To allow the position of the handle to be changed, the pin 255 is withdrawn against the spring pressure and the handle move to the desired position. When released, the pin moves into place in one of the positive stops 254 and 256.

The center of mass of the push stick 200 is such that it may rest upright on the bottom plate 210 when not in use. The center portion 220 includes an engagement end 222 that contacts the rear end of the work piece to transmit a forward thrust to the work piece. The center portion 220 is sized so that the end of the work piece passes the center of the cutting element while the handle 240 remains behind the leading edge of the cutting element. This requires the center portion to be approximately 5 to 6 inches between the engagement end 222 and the handle pivot point 252.

The push stick 200 is notched at the forward end of the flat bottom plate 210, in the same manner as shown for the push stick 100 of FIG. 3. Similarly, the width of the flat bottom plate 210 is sized to provide stable operation of the push stick 200 when used on a flat surface.

Figure 5:
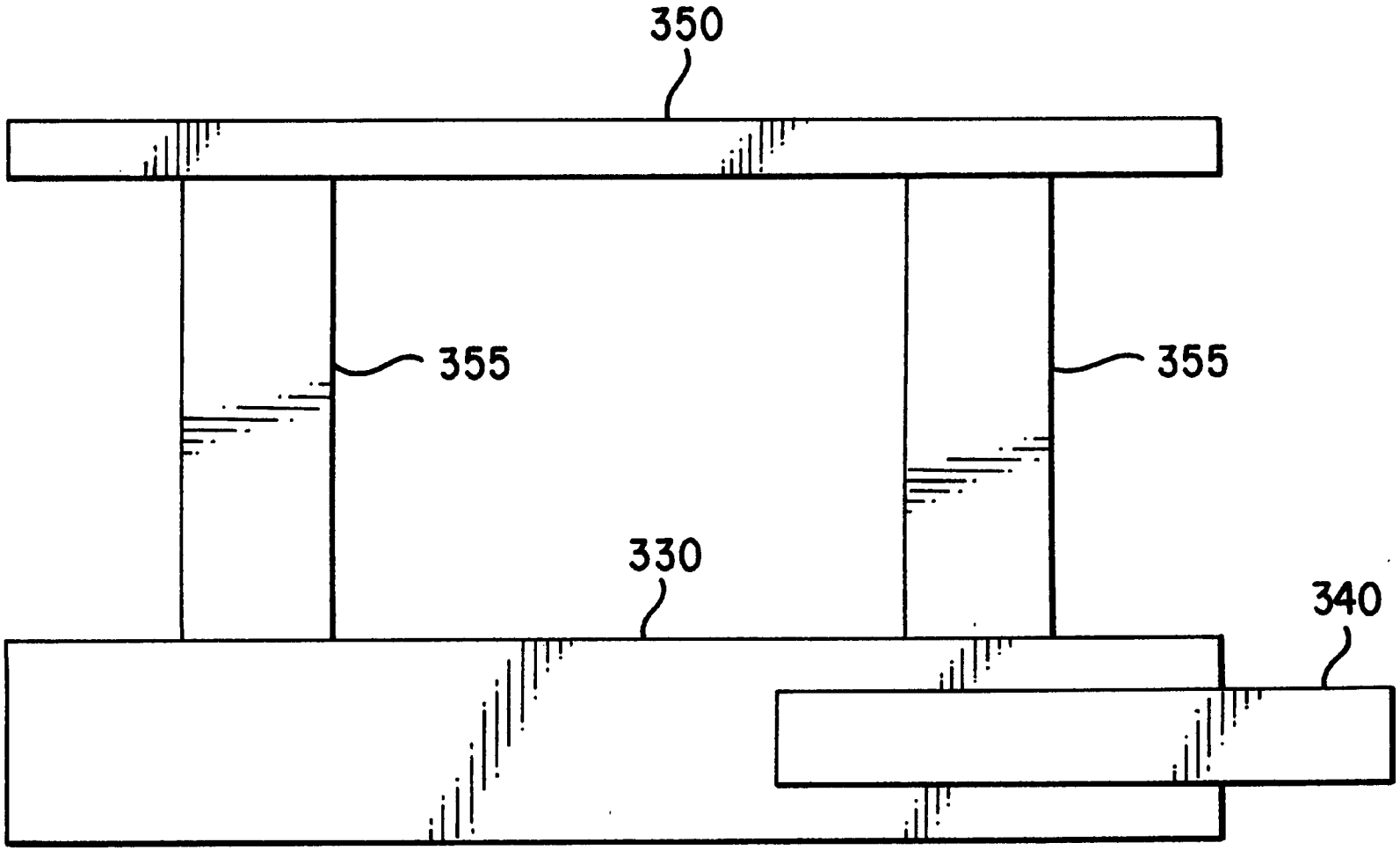
FIG. 5 is a top view of the push stick according to yet another embodiment of the invention.

FIG. 5 is a top view of a push stick 300 according to another embodiment of the invention. In FIG. 5, the push stick 300 includes a main portion 330, an elongate handle 340, a secondary portion 350, and connecting bridges 355 that attach the main portion 330 to the secondary portion 350. The secondary portion 340 is narrower than the main portion 330, and is sized to allow application of downward and forward pressure on a narrow work piece that is pushed between the cutting element and the fence on the table saw. The cutting element passes through the space existing between the main portion 330 and the secondary portion 350. The height of the bridges 355 is chosen so that the cutting element at its most extreme height passes safely beneath the bridge 355. For a 12-inch diameter circular saw blade, the maximum cutting height is 4⅝ inches. Thus, the underside of the bridge 355 would be approximately 4¾ inches above the surface of the table saw. By using a push stick with the main portion 330 and the secondary portion 350, rip cuts can be safely made, even when the cutoff piece is narrow.

In the above embodiment of the push stick 300, the main portion 330 and the secondary portion 350 are shown connected by a fixed bridge 355. Alternately, the bridge 355 can be made to be detachable. In this alternate embodiment, the main portion 330 can be used separately as a single push stick, providing more versatility.

Figure 6:
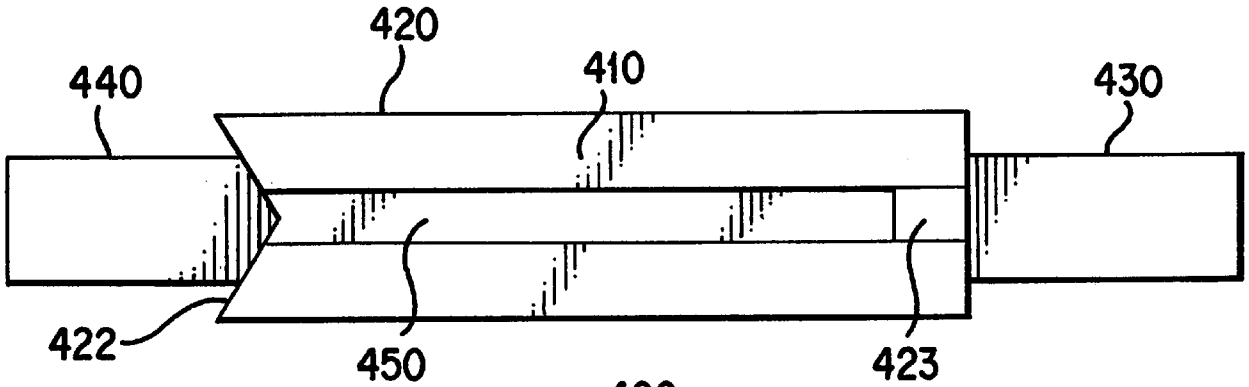
FIG. 6 shows still another embodiment of the push stick according to the invention.

FIG. 6 is a bottom view of a push stick 400 according to yet another embodiment of the invention. The push stick 400 includes a flat base plate assembly (or base plate) 410, a center section 420 having a working end portion 422, an elongate handle 430, and a hold down section 440. The center of gravity of the push stick 400 is such that the push stick 400 will stand on its base plate 410 in a stable configuration, making for easy storage and accessibility of the push stick 400. Also as shown in FIG. 6, the hold down section 440 is of sufficient length to provide a downward thrust on the work piece during most cutting operations. The center section 420 is also of sufficient length to allow the push stick 400 to push the work piece completely beyond the center of the cutting element without the operator's hands reaching the leading edge of the cutting element. For the standard table saw, this means that the center section 420 is at least 6 inches in length. In this way, the end of the work piece will be beyond the center of the rotating element without the operator's hand reaching over the top of the rotating cutting element. With the end of the work piece beyond the center of the cutting element, there is little force available to lift the work piece or to project in rearward. The handle 430 is designed to apply the maximum downward force and forward thrust through the cutting element. Optimally, the handle is formed at about a 45-degree angle with respect to the plane of the base plate 410. Thus, the force applied by the operator is evenly divided to counteract both the upward and rearward forces created by the cutting element. For many cutting operations involving a table saw, the push stick 400 will provide for safe and reliable cutting operations.

The push stick 400 may be used with work pieces of varying thicknesses. To ensure the push stick 400 makes contact with the table surface of a stationary power tool (not shown), the base plate 410 of the push stick 400 is made adjustable in thickness to account for work pieces of varying thicknesses.

Figure 6A:
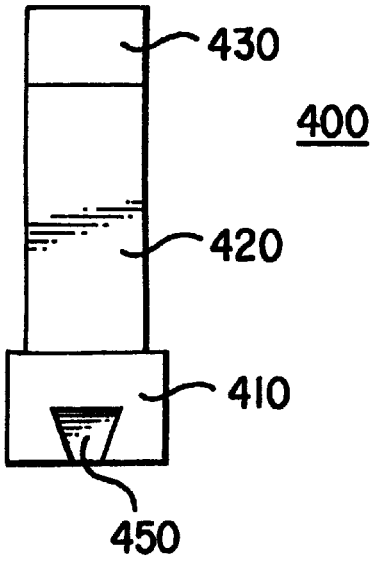
FIG. 6A is a front view of the push stick of FIG. 6.

The base plate 410 of the push stick 400 includes a longitudinal groove 450 located at the center of the base plate 410. The groove 450 runs from the working end portion 422 to a stop portion 423. The groove 450 is dove-tailed in cross-section to accept a corresponding shim. FIG. 6A is a front view of the push stick 400 showing the dove-tail construction of the groove 450.

Figure 7:
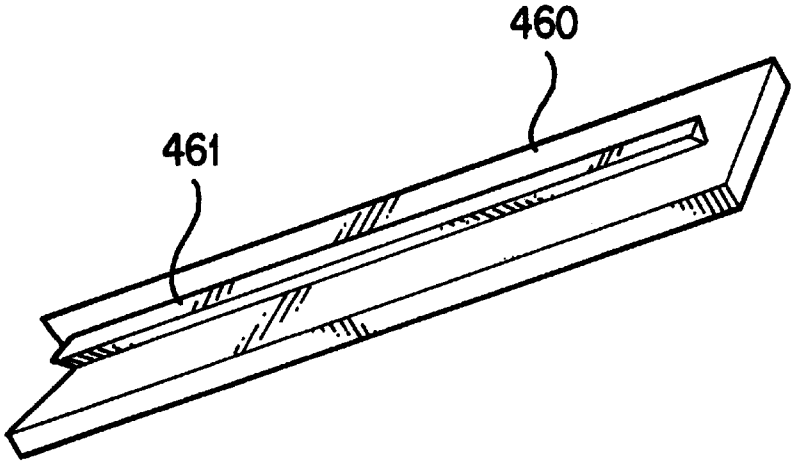
FIG. 7 shows a shim adapted for use with the push stick of FIG. 6.
Figure 7A:
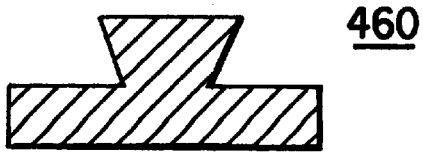
FIG. 7A shows the shim of FIG. 7 in cross-section.
Figure 7B:
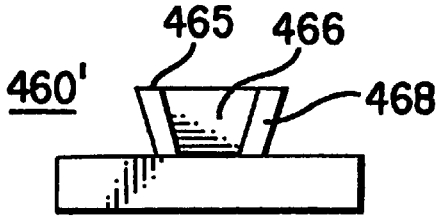
FIG. 7B is a front view of the an embodiment of a shim.
Figure 7C:
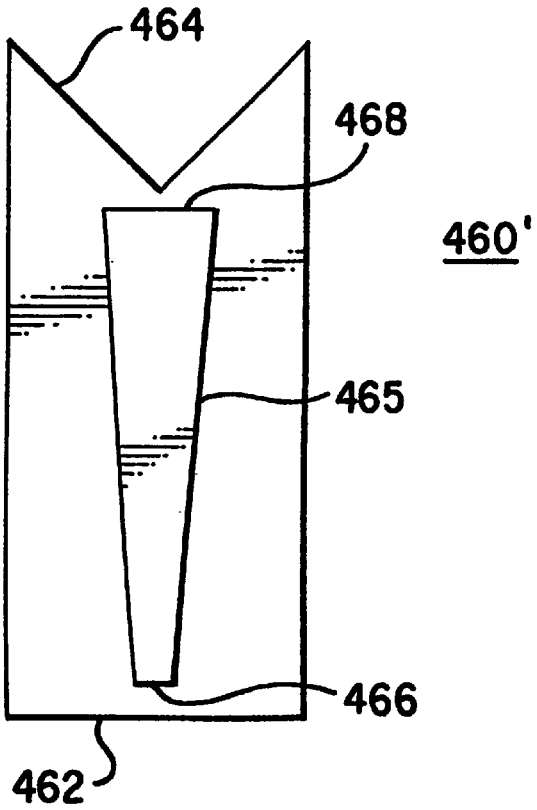
FIG. 7C is a top view of the shim of FIG. 7B.

FIG. 7 shows a shim 460 adapted for insertion in the groove 450. The shim 460 has a length corresponding to the length of the base plate 410. The shim has a rear end 462 and a front end 464 that is notched to match a corresponding shape of the base plate 410. The shim 460 includes a tail 461 that is shaped to fit the groove 450. The length of the tail 461 corresponds to the length of the groove 450. In this way, when the shim 460 is inserted into the base plate 410, the shim 460 will be prevented from being ejected by means of the stop portion 423. The groove 450 and tail 461 are shown in FIGS. 6 and 7 as being of a sliding dove-tail configuration. Alternately, the groove 450 and tail 461 can be formed in a tapered sliding dove-tail configuration. In this way, the shim 460 will slide easily into the base plate 410, with the fit becoming tight only in the last portion of travel. FIG. 7A shows the shim 460 in cross-section. FIG. 7B shows a rear view of a shim 460' having a tapered sliding dove-tail 465. A rear end 466 of the dove-tail 465 is smaller in cross-section than a front end 468 of the dovetail. 465. FIG. 7C is a top view of shim 460' showing the tapered sliding dove-tail 465 becoming wider from the rear end 466 to the front end 468.

Use of the shim 460 allows the push stick 400 to be used on work pieces of varying thicknesses. For example, the push stick 400 could be constructed to be used with ¾ inch-thick work pieces. Shims could then be available in ⅛ inch, ¼ inch, ½ inch-thicknesses, and larger, for example.

The embodiments of the push stick described above are all capable of being used at any point in the surface of a power tool table. For example, a table saw can be described having a circular saw blade extending through a slot in the table surface. A plane x-x' can be described that defines the plane of the table. The saw blade rotates in a plane y-y' that can be perpendicular to the plane x-x', or can be inclined at some acute angle to the plane x-x'. Because the push stick has a flat bottom surface for contacting the table, the push stick can be used over any portion of the table on the plane x-x', and is specifically not limited to travel a path defined by one or more grooves that may be milled into the surface of the table.

Although not shown, a shim could also be provided for use with the push stick 400, the shim having a raised portion on a bottom surface that contacts the table of the power tool. The raised portion could be in the shape of a dove tail or a square or rectangular in cross section. The raised portion would be sized to fit into one of the grooves commonly found in table saws and shpers. The shim would then fit the push stick 400 in the same manner as the shim 460.

While the invention has been described with reference to specific embodiment, these embodiments are meant to be illustrative and not limiting. Many variation of the above embodiments, which will be obvious to those of ordinary skill in the art, are encompassed by the following claims.

I claim:

1. A push stick for pushing a work piece over a table surface of a stationary power tool, comprising;

a central section formed about a center of gravity of the push stick;

flat plate means formed on a bottom of the central section for substantially completely contacting the table surface of the stationary power tool, wherein a width of the flat plate means is wider than a width of the central section;

an elongate handle connected to the central section; and a hold down section, located forward of the central section, and connected to the central section, wherein the push stick has a center of gravity such that the push stick is capable of resting on the flat plate meal, and wherein in operation, the flat plate means rides on the table surface of the stationary power tool.

2. The push stick of claim 1, wherein the elongate handle is fixed at an angle of forty-five degrees with respect to the flat plate means.

3. The push stick of claim 1, wherein the elongate handle is movable between an angle of zero degrees and ninety degrees with respect to the flat plate.

4. The push stick of claim 1, further comprising a notched section formed at a forward end of the flat plate means, the flat plate means having a length of between five and six inches.

5. The push stick of claim 1, wherein the push stick is constructed of a material selected from a group consisting of hardwoods, plywood, and a polymeric material.

6. The push stick of claim 1, wherein the elongate handle includes ridges and a thumb stop.

7. The push stick of claim 1, wherein the elongate handle has a length of six to seven inches.

8. A push stick for pushing a work piece over a table surface of a stationary power tool, comprising:

a central section;

a flat plate formed on a bottom of the central section, wherein a width of the flat plate is wider than a width of the central section;

an elongate handle connected to the central section; and a hold down section, located forward of the central section, and connected to the central section, wherein the push stick has a center of gravity such that the push stick is capable of resting on the flat plate, and wherein in operation, the flat plate rides on the table surface of the stationary power tool;

a secondary portion, the secondary portion positioned parallel to a longitudinal axis of the central section, wherein a width of the secondary portion is less than a width of the central section;

a bridge fixedly attached to the secondary portion and the central section, wherein a height of the bridge is approximately 5 inches such that a cutting element passes beneath the bridge and between the secondary portion and the central section.

9. The push stick of claim 8, wherein the push stick is formed as a single piece.

10. The push stick of claim 8, wherein the secondary section and the bridge are separable.

11. A push stick for pushing a plurality of workpieces on a table surface, the workpieces having different thicknesses, comprising;

a central section;

an elongate handle connected to the central section;

a hold down section connected to the central section;

a bottom plate assembly connected to the central section; and a plurality of shims, wherein the plurality of shims comprises a ¼ inch shim, a ½ inch shim, and a ¾ inch shim, the bottom plate assembly receiving one of the plurality of shims, wherein the bottom plate assembly is adjustable in thickness by receiving one of the plurality of shims and such that the shim received in the bottom plate assembly remains substantially in contact with the table surface when pushing the workpieces.

12. The push stick of claim 11, wherein a width of the bottom plate is wider than a width of the central section.

13. The push stick of claim 11, wherein the bottom plate assembly includes a longitudinal groove including a stop portion, each of the plurality of shims including a tail piece adapted to be received by the groove.

14. The push stick of claim 13, wherein the groove and the tail are in the form of a sliding dove tail, and wherein the tail has a length corresponding to the length of the groove, and the shim has a length corresponding to a length of the base plate assembly.

15. The push stick of claim 14, wherein the sliding dove tail is a tapered sliding dove tail.

16. The push stick of claim 11, wherein the elongate handle is at an angle of zero degrees with respect to the base plate assembly.

17. The push stick of claim 11, wherein the elongate handle is at an angle of 45 degrees with respect to the base plate assembly.

18. The push stick of claim 11, wherein an angle of the elongate handle with respect to the base plate assembly is adjustable.

19. The push stick of claim 11, further comprising a notched section formed at a forward end of the central section.

20. The push stick of claim 11, wherein the push stick is constructed of a material selected from a group consisting of hardwoods, plywood, and a polymeric material.

* * * * *